US006533650B2

(12) United States Patent
Yoshida et al.

(10) Patent No.: US 6,533,650 B2
(45) Date of Patent: Mar. 18, 2003

(54) GRINDING STONE

(75) Inventors: Takuma Yoshida, Ebina (JP); Nobuo Fukada, Ebina (JP); Shigeyoshi Kobayashi, Ebina (JP); Hirohide Fukudome, Ebina (JP)

(73) Assignee: Sankyo Diamond Industrial Co., Ltd., Ebina (JP)

( * ) Notice: Subject to any disclaimer, the term of this patent is extended or adjusted under 35 U.S.C. 154(b) by 0 days.

(21) Appl. No.: 09/926,704

(22) PCT Filed: Apr. 3, 2001

(86) PCT No.: PCT/JP01/02890

§ 371 (c)(1),
(2), (4) Date: Dec. 5, 2001

(87) PCT Pub. No.: WO01/76821

PCT Pub. Date: Oct. 18, 2001

(65) Prior Publication Data

US 2002/0137444 A1 Sep. 26, 2002

(30) Foreign Application Priority Data

Apr. 5, 2000 (JP) ..... 2000-103209

(51) Int. Cl.[7] ..... B23F 21/03
(52) U.S. Cl. ..... 451/548; 451/547
(58) Field of Search ..... 451/548, 550, 451/259, 178, 353, 359, 541, 547

(56) References Cited

U.S. PATENT DOCUMENTS

| | | | | | |
|---|---|---|---|---|---|
| 2,496,352 | A | * | 2/1950 | Metzger et al. | |
| 5,496,209 | A | * | 3/1996 | Gaebe | 451/548 |
| 5,832,360 | A | * | 11/1998 | Andrews et al. | 428/552 |
| 5,911,620 | A | * | 6/1999 | Spangenberg et al. | 451/548 |
| 6,238,280 | B1 | * | 5/2001 | Ritt et al. | 451/540 |
| 6,299,522 | B1 | * | 10/2001 | Lee | 451/548 |

FOREIGN PATENT DOCUMENTS

| | | |
|---|---|---|
| JP | 78567/1986 | 5/1986 |
| JP | 5-369671 | 10/1993 |
| JP | 9-285970 | 11/1997 |
| JP | 10-264041 | 10/1998 |

* cited by examiner

*Primary Examiner*—Eileen P. Morgan
(74) *Attorney, Agent, or Firm*—Oblon, Spivak, McClelland, Maier & Neustadt, P.C.

(57) ABSTRACT

An offset type grindstone having a circular metal substrate provided in a central section thereof with a recess having a hole used to mount the grindstone on a power tool, and a grindstone portion including one layer of either diamond grains or CBN grains and formed in one body so as to extend continuously in the direction of an outer circumference of a front surface of the recess, in which grindstone the concentration of the grains on the grindstone portion is set high in a region of an outer circumferential end section thereof, and low in the other region thereof. This grindstone is superior in lifetime with a very high grinding speed and a high flat grindability attained at once.

20 Claims, 3 Drawing Sheets

GRINDING STONE

BACKGROUND OF THE INVENTION

1. Field of the Invention

This invention relates to an offset type grindstone suitably used to grind hard, fragile materials, such as concrete, stones and the like, and more particularly to a grindstone having a so-called super-grain grindstone portion formed of diamond grains or cBN grains and provided on a grindstone portion mounting section of an offset type steel substrate.

2. Description of the Background

An offset type grindstone formed by fixing so-called super-grains, such as diamond grains or cBN grains and the like on a metal substrate by electrodeposition or a metal bond-sintering method has heretofore been widely used as a tool for subjecting hard, fragile materials, such as stones and concrete to a grinding operation.

A general purpose grindstone of an electrodeposition method which is being manufactured commercially at present is formed by fixing super-grains densely on a surface of an offset type base metal (metal substrate) by electroprecipitation plating of nickel. On the other hand, a grindstone of a metal bond-sintering method is formed by sinter-combining super-grains, such as diamond grains and the like on a surface of an offset type base metal in the same manner by metal bonding.

Since the above-mentioned grindstone of an electrodeposition method has a very large number of grains fixed densely on a grindstone portion, the flat-grinding characteristics thereof with respect to a material to be ground, displayed during a grinding operation are excellent, and a beautiful finished surface is obtained easily. However, this grindstone is cursed by its structure having densely fixed grains, i.e., the height of projecting grains is small, so that actuating depth of each grain with respect to a material to be ground becomes small. Therefore,chips occurring become finer to cause the surface of the grindstone to encounter a phenomenon of being clogged therewith, and this constitutes a primary factor of lowering a grinding speed greatly.

In the case of a grindstone of a metal bond-sintering method, it is possible to reduce an area of a free end which contacts in design a material to be ground of the grindstone, as well as a concentration (compounding ratio) of the grains. Accordingly, it is comparatively easy to obtain an excellent grinding speed but a new problem occurs, i.e., the flatness of a finished surface becomes defective due to a large cutting depth of the grains with respect to a material to be ground. Under the circumstances, attempts are being made to hold down an excessive intrusion of the grains into a material to be ground, by increasing the area of a free end of a grindstone portion or forming the grindstone portion to a spacing material-buried structure for the purpose of improving the flat grindability of the grindstone portion with respect to a material to be ground.

A very high grinding speed and a high flat grindability thus have an antinomic relation, and a worker is pressed under necessity to select a grindstone among grindstones designed in accordance with different purposes, and use selected grindstones for their respective purposes. Therefore, even when such kind of work that is other than work in which a grinding operation is carried exclusively, and in which a surface of a small area is subjected to from a rough grinding operation to a finishing grinding operation in a short period of time, it is necessary to prepare a roughing grindstone and a finishing grindstone in advance, and forward the work by attaching these grindstones in due order to a power tool, such as a disc grinder, etc. in accordance with the progress of the work. Under the circumstances, improving a work efficiency and reducing the cost have been demanded.

In the case of a grindstone of a metal bond-sintering method, a metal-bonded grindstone having a large bulk and heavy weight also has a structure formed by fixing the grindstone to a base metal by welding or brazing. Therefore, the securing the rigidity of the base metal is demanded in view of the construction of this grindstone, and the thickness of the base metal is necessarily set large. Consequently, when a grinding operation, especially, the grinding of a wall surface and a ceiling is carried out by mounting this grindstone on a power tool, such as a disc grinder and the like as a hand tool, a worker's fatigue increases due to a load ascribed to the weight and a gyroscopic effect of the grinder, and a high degree of skill of a worker is required.

As described above, a related art grindstone has to sacrifice either the very high grinding speed or the high flat grindability. It has strongly been demanded from the view point of the cost and work efficiency that a grindstone capable of attaining the two characteristics be developed. The present invention has been made in view of the above circumstances, and provides a grindstone capable of solving such problems and attaining a very high grinding speed and a high flat grindability at once.

SUMMARY OF THE INVENTION

The grindstone according to the present invention made so as to solve the above-mentioned problems is an offset type grindstone having a circular metal substrate provided in a central section thereof with a recess having a hole used to mount the grindstone on a power tool, and a grindstone portion including one layer of either diamond grains or cBN grains and molded in one body so as to extend continuously in the direction of an outer circumference of a front surface of the recess, in which grindstone controlling the concentration (the number of grains per unit area: a compounding ratio) of the grains on the grindstone portion so that the concentration is high in a region of an outer circumferential end section thereof, and lower in the other region thereof than that in the mentioned high-concentration region constitutes the characteristic structural requirements.

To be more exact, the concentration of the grains on the part of the grindstone portion which corresponds to an outer circumferential end section of the circular metal substrate and the concentration thereof in a region thereof extending from the outer circumferential end section toward the center of the substrate by a distance in the vicinity of 0 to 10 mm, preferably 0 to 5 mm is set high so that the concentration is in the range of 50 to 1600 (grains/cm$^2$) while the concentration in the other region of the grindstone portion is set in the range of 5 to 400 (grains/cm$^2$) which is lower than that in the mentioned highly-set regions.

In the offset type grindstone in another example of the present invention, the concentration of the grains on the grindstone portion is set high in a region of an outer circumferential end section as mentioned above, slightly high in the innermost circumferential section of the grindstone portion and in a region extending from the innermost circumferential section toward an outer circumference by within 0 to 10 mm, and lower in the other region than that of any of the mentioned highly-set regions. This also constitutes one of the characteristic structural requirements.

Among the methods of fixing grains to a metal substrate during the formation of a grindstone portion, a furnace brazing method using brazing filler metal is selected as the best method.

In the grindstone according to the present invention, a grindstone portion is provided preferably so as to incline from a substantially radially central part thereof toward an outer circumference thereof. It is also preferable that at least plural stripes of non-grain-fixed regions be provided on the grindstone portion of the grindstone. Providing at least not less than one through hole in a region other than the grindstone portion-fixed part of a circular metal substrate also constitutes one of preferred modes of embodiment.

DESCRIPTION OF THE PREFERRED EMBODIMENTS

The modes of embodiment of the present invention will now be described more concretely on the basis of the attached drawings.

Figure 1:
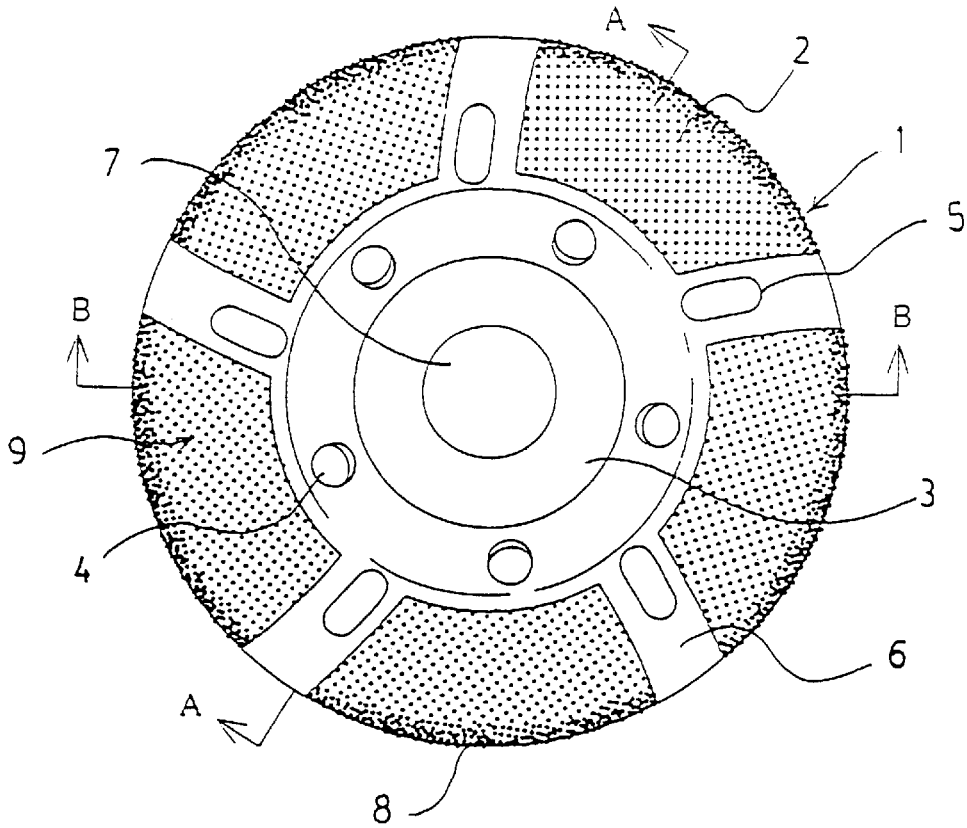
FIG. 1 is a front view of the grindstone according to the present invention.

An example of the grindstone according to the present invention is an offset type grindstone provided as shown in the front view of FIG. 1 in a central portion of a circular metal substrate 1 with a recess 3 having a hole 7 for mounting the grindstone on a power tool. A grindstone portion 9 formed of one layer of grains 2 selected from diamond grains and cBN grains (which will hereinafter be referred to simply as "grains" in some cases) is provided so as to extend continuously from an outer circumferential end section of the recess 3 toward an outer circumferential end section of the circular metal substrate 1 and so as to be made in one body with the substrate.

The one grain layer provided on the grindstone portion 9 is designed so that the concentration of the grains 2 is high in a region close to an end section 8 of the circular metal substrate 1, and lower in the other region than that in the mentioned highly-set region. To be exact, the concentration of the grains 2 on the grindstone portion 9 is set high so that the concentration reaches a level in a range of 50 to 1600 (grains/cm$^2$) in the end section 8 of thecircular metal substrate 1 and a region extending from the end section 8 toward the center thereof to a width of 0 to 10 mm, preferably in such a region extending to a width of 0 to 5 mm, while the concentration of the grains 2 on the grindstone portion 9 in a region other than the mentioned region is set in a range of 5 to 400 (grains/cm$^2$) and lower than that in the mentioned highly-set regions.

In order to grind flat a material to be ground in a substantial grinding operation, it is desirable to apply a grindstone surface to the material to be ground, in parallel therewith, and grind the material so that a grinding area of the grindstone reaches the highest possible level. When the grains on a grindstone surface aggregate densely, i.e., when the concentration of the grains 2 on the grindstone portion 9 exceeds 400 (grains/cm$^2$), a sufficient cutting load of each grain is not obtained. Moreover, the height of projecting parts of the grains is rendered substantially uniform, and a cutting depth of the grains with respect to the material to be ground becomes insufficient. Consequently, the chips occurring become fine to cause the grindstone surface to be clogged therewith, and this constitutes a primary factor of lowering a grinding speed greatly.

In the grindstone according to the present invention, the concentration of grains on the grindstone portion 9 except the end section 8 of the circular metal substrate 1 and the high grain concentration region extending from the end section 8 toward the center of the substrate by 0 to 10 mm is controlled to be in the range of 5 to 400 (grains/cm$^2$). Consequently, a suitable number of and a suitable distance among grains on the surface of the grindstone portion 9 are attained, and a balance of the intrusion of the grains into the material to be ground and the discharging of chips occurring on the grindstone portion 9 is maintained properly. As a result, a decrease, which is ascribed to the clogging of the grindstone portion 9 with the chips, in the cutting speed is prevented, and the very high grinding speed and the high flat grindability are rendered compatible with each other.

When a material to be ground has a high degree of unevenness, or in order to grind an object material deep, or in order to grind a right-angled corner of an object material, a worker is put under pressure to carry out a grinding operation with the end section 8 of the grindstone applied intentionally strongly to the material. In such a case, a large load is imparted to the end section 8, so that the grains 2 provided on the part of the grindstone portion which is in the vicinity of the end section 8 wear noticeably. Therefore, the lifetime of the grindstone terminates, though the other region of the grindstone portion still maintains a sound condition.

In the grindstone according to the present invention, the concentration of the grains 2 in the end section 8 of the grindstone portion 9 and the region extending from the end section 8 toward the central portion of the grindstone by 0 to 10 mm, preferably 0 to 5 mm is set high so that the concentration is in the range of 50 to 1600 (grains/cm$^2$). Owing to this arrangement, a structure capable of preventing the abrasion of the grains 2 in the region in the vicinity of the end section 8 is formed. Even when the concentration of the grains 2 in the region in the vicinity of the end section 8 is set high as mentioned above, a load per unit area is sufficiently high, so that the very high grinding speed is maintained with the durability of the grindstone ensured at the same time.

Figure 2:
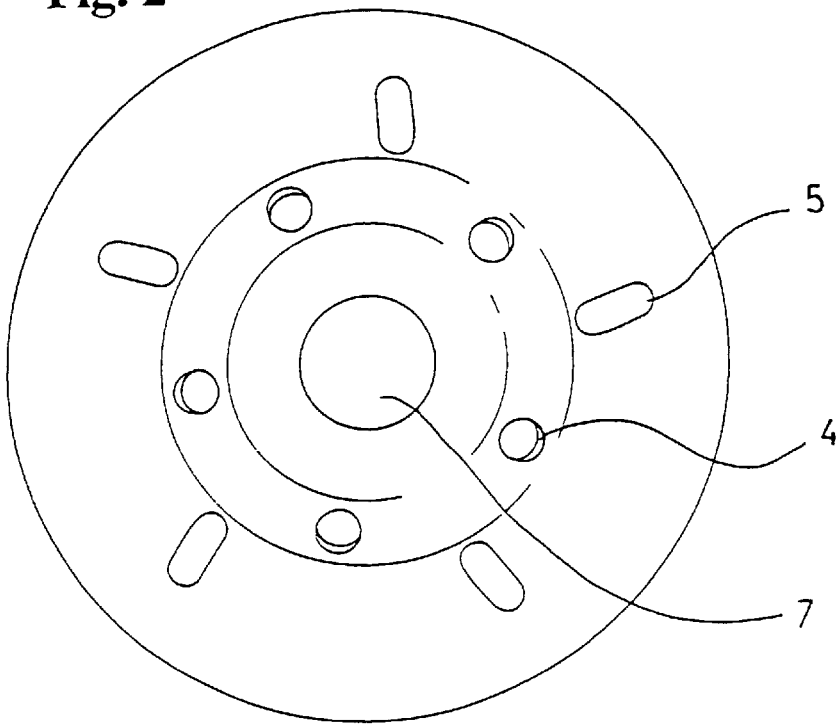
FIG. 2 is a rear view of the grindstone.
Figure 4:
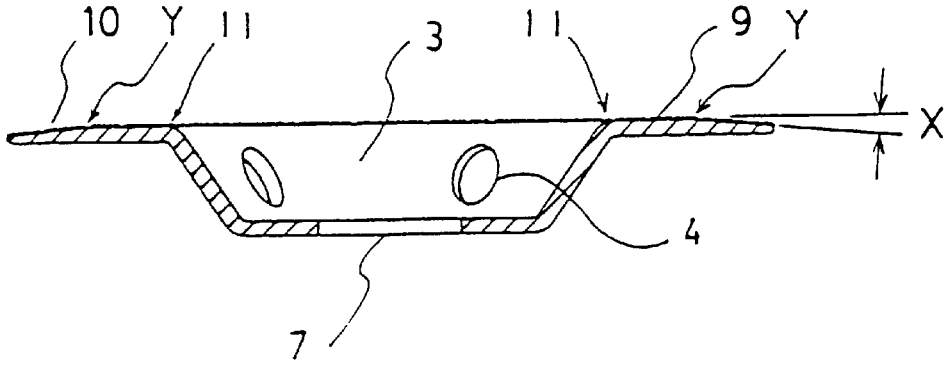
FIG. 4 is a sectional view taken along the line B—B in FIG. 1.
Figure 5:
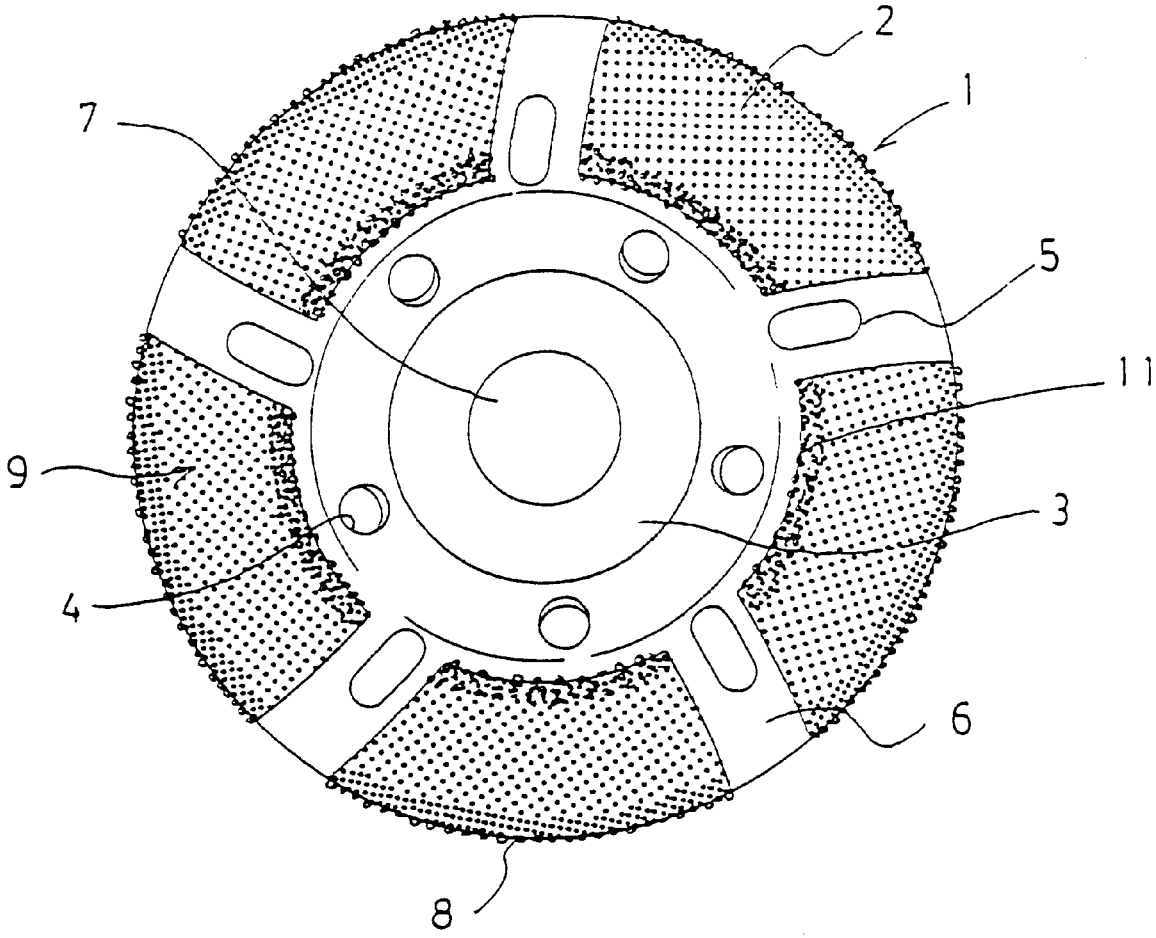
FIG. 5 is a front view of another embodiment of the grindstone according to the present invention.

FIG. 5 is a front view showing a grindstone as another example of the present invention. According to this grindstone, the concentration of grains 2 on an innermost circumference 11 of a grindstone portion 9 thereof and a region (which will hereinafter be referred to also as an offset portion) extending from the innermost circumference 11 toward an outer circumference of the grindstone by within 0 to 10 mm is set high, specifically at 30 to 1600 (grains/cm$^2$), in addition to the provision of the same structure as mentioned above in which the concentration of grains 2 on an end section 8 of the grindstone portion 9 and a region extending from the end section 8 toward the center of the grindstone by within 0 to 10 mm is set high. This arrangement enables, for example, during an operation for grinding a corner portion and a projecting portion of an object material the prevention of the progress of wear on the offset portion and the influence of the worn offset portion upon the lifetime of the grindstone. A rear structure, etc. of the grindstone in this example are expressed in the same manner as in FIG. 2 to FIG. 4.

A method of fixing the grains 2 to the circular metal substrate 1 can be selected suitably from known methods. Namely, either brazing using a self-melting metal containing nickel as a main component or electrodeposition using a nickel plating method can be selected suitably. According to the present invention, furnace brazing using a self-melting metal containing nickel as a main component is an optimum method.

Figure 3:
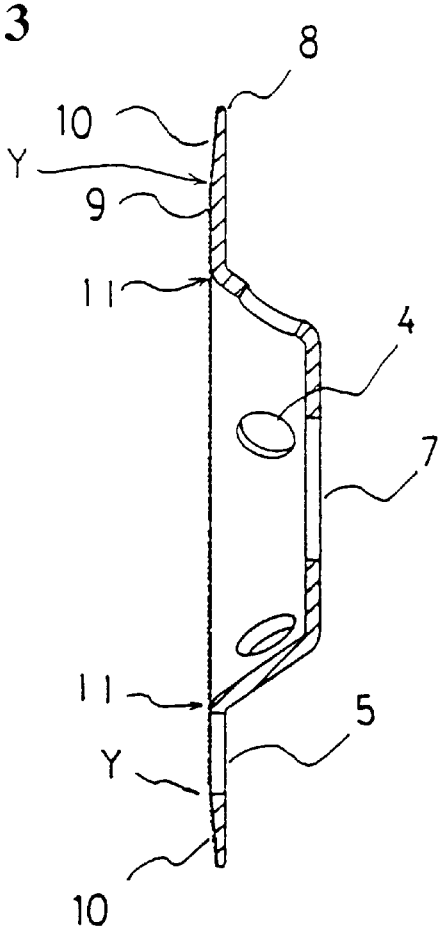
FIG. 3 is a section al view taken along the line A—A in FIG. 1.

An outwardly lowering inclined section 10 is provided as shown in FIG. 3 and FIG. 4 on a region extending from a point Y, substantially the radial center of the grindstone portion 9 of the grindstone to the end section 8 on the outer circumference of the grindstone. This inclined section 10 is molded so that the inclined portion extends from the substantial radial center of the grindstone portion 9, to be exact, from a point Y in the vicinity of a point on a circle of 85 mm in diameter when the grindstone has a diameter of 106 mm, toward the outer circumferential end section 8 so as to have an angle (X) of downward inclination of 1 to 15 degrees, and preferably 3 to 10 degrees. The inclined section 10 is not like a corresponding part of a curved shape of a known offset grindstone but has a flat grindstone surface of the above-mentioned angle of inclination. Thus, the end section 8 of the grindstone according to the present invention comes to have an acuter angle, and this enables the grains to make a sharp cut into a material to be ground, and a very high grounding speed and a high flat grindability to be secured.

When the inclined section 10 is formed so as to have a part of a curved shape just as a known offset type grindstone, a suitable use of the grindstone according to the present invention for an inner surface grinding operation for a cylindrical material to be ground is not prevented.

The grindstone portion 9 of the grindstone according to the present invention is provided with at least plural stripes of non-grain-fixed regions 6. When the non-grain-fixed regions 6 are provided, the discharging of the chips occurring during a grinding operation is done excellently, and the work efficiency is improved with a very high grinding speed maintained. Although the mode of the non-grain-fixed regions 6 may be determined arbitrarily within the scope in which the above-mentioned purposes can be met, it is preferable that the non-grain-fixed regions 6 be formed so as to extend substantially in the radial direction of the grindstone portion 9 and at regular intervals in the circumferential direction. The number of the non-grain-fixed regions 6 is preferably 2 to 10, and more preferably 4 to 6.

It is preferable that the recess 3 of the circular metal substrate 1 be provided with at least not less than one of hole 4, and specially preferable that the recess 3 and non-grain-fixed regions 6 be provided with at least not less than one each of the hole 4 and hole 5. Owing to the holes 4 and 5, the weight of the grindstone is reduced, and the accumulation of heat during a grinding operation is prevented. The shape, size and number of the holes 4 and 5 are determined arbitrarily as long as these holes enable a sufficient strength of the grindstone to be secured, and the above-mentioned purposes to be met.

EMBODIMENTS

The embodiments of the present invention will now be described more concretely on the basis of FIG. 1 to FIG. 5. The present invention is not limited to these embodiments, and can be modified freely in design within the scope of the gist thereof.

Embodiment 1

As shown in FIG. 1 to FIG. 4, the grindstone according to this embodiment is formed by providing a grindstone portion 9 on a circular metal substrate 1 of 2 mm in thickness and 106 mm in diameter provided with a hole 7 in the center thereof for use in mounting the grindstone on a power tool, and a recess 3 of about 60 mm in maximum inner diameter, about 40 mm in minimum inner diameter and about 13 mm in depth having five circular through holes 4. The circular metal substrate 1 is also provided with an inclined section 10 extending downward at an angle of inclination of five degrees on a front grinding surface (belt-like surface surrounded by a circumference of about 60 mm in diameter and a circumference of 106 mm in diameter), i.e. a surface section extending from a point Y in the vicinity of a circle of 85 mm in diameter, which passes the substantial radial center of the grindstone portion 9, to an outer circumferential end section 8. The grindstone portion 9 is provided with five circumferentially equally divided non-grain-fixed regions 6 of 10 mm in width extending in the radial direction. The non-grain-fixed regions 6 are provided with elliptic through holes 5. In this embodiment, diamond grains of 35 to 45 mesh in grain size were used as grains, which were fixed by furnace brazing using brazing filler metal containing nickel as a main component with the concentration of the grains on the grindstone portion 9 controlled to be 300 (grains/$cm^2$) in the end section 8 and a region of 2 mm in width extending from the end section 8 toward the center of the metal substrate, and 45 (grains/$cm^2$) in the other region. The offset type grindstone according to the present invention thus manufactured had total weight of 135 g.

Such a grindstone as described above was mounted on an electric disc grinder, and a dry grinding test was conducted on a concrete plate of an age of one and 15 mm in aggregate grain size at a rotational speed of 12,000 rpm. As a result, it was ascertained that the grindstone was excellent in work efficiency and capable of obtaining a good flat ground surface easily and carrying out a high speed grinding operation of 80 (g/min) in grinding speed (object material removing speed). It was further ascertained that the clogging of the grindstone portion 9 with chips did not occur, and that the grindstone could withstand a continuous operation. A grinding operation attaining 8.8 kg in total weight of the object material ground to powder could practically be carried out until the time at which a judgement that the grains on the end section 8 were damaged to terminate the lifetime of the grindstone was given.

Embodiment 2

A grindstone was manufactured in the same manner as in Embodiment 1 except that an angle of inclination of an inclined section 10 was set to 10°; diamond grains of 20 to 30 meshes in grain size were used; and the concentration of the grains on an end section 8 and a region of 2 mm in width extending from the end section 8 toward the center of a metal substrate was set to 70 (grains/$cm^2$) with that of the grains on the other region set to 9 (grains/$cm^2$), and a grinding test was conducted under the same conditions as in Embodiment 1. As a result, the grinding speed was 95 (g/min), and the weight of the object material which could be ground to powder 6.1 kg. Concerning other points, substantially the same results as in Embodiment 1 were obtained.

Embodiment 3

A grindstone was manufactured in the same manner as in Embodiment 1 except that diamond grains of 50 to 70 meshes in grain size were used; the concentration of the grains on an end section 8 and a region of 1 mm in width extending from the end section 8 toward the center of a metal substrate was set to 1200 (grains/$cm^2$); and the concentration of the grains on the other region was set to 260 (grains/cm$^2$). A grinding test was conducted under the same conditions as in Embodiment 1. As a result, a grinding speed was 60 (g/min), and the weight of the object material which could be ground to powder 7.4 kg. Concerning other points, substantially the same results as in Embodiment 1 were obtained.

Embodiment 4

A grindstone was manufactured in the same manner as in Embodiment 1 except that diamond grains of 30 to 40 meshes in grain size were used; the concentration of the grains on a grindstone portion 9 was set as shown in FIG. 5 to 200 (grains/cm$^2$) in an end section 8 and a region of 2 mm in width extending from the end section 8 toward the center of a metal substrate, 60 (grains/cm$^2$) in an innermost circumferential section 11 of the grindstone portion 9 and a region of 7 mm in width extending from the innermost circumferential section 11 toward an outer circumference thereof, and 47 (grains/cm$^2$) in the other region. An operation for grinding an uneven surface and a corner portion of a material to be ground was carried out by using the grindstone thus obtained, under the same conditions as in Embodiment 1. As a result, a grinding speed reached 100 (g/min), and the lifetime of a region in the vicinity of the innermost circumferential surface 11 of the grindstone portion 9, a region in the vicinity of the end section 8 and the other region became substantially equal. The weight of the object material which could be ground to powder reached as high as 27 kg.

COMPARATIVE EXAMPLE 1

A grindstone was manufactured in the same manner as in Embodiment 1 except that the grain size of the diamond grains used was set to 50 to 70 meshes; and the concentration of the grains on the whole region of a grindstone portion 9 was set to 1450 (grains/cm$^2$). A test for grinding granite was conducted under the same conditions as in Embodiment 1. As a result, a grinding speed reached 15 (g/min), and the clogging of the grindstone portion 9 with chips occurred immediately after the starting of the operation to make it impossible to continue the operation.

COMPARATIVE EXAMPLE 2

A grindstone was manufactured by using diamond grains of 35 to 45 meshes in grain size, and setting the concentration of the grains on the whole region of a grindstone portion 9 to 300 (grains/cm$^2$). A test for grinding concrete was conducted under the same conditions as in Embodiment 1. As a result, a grinding speed reached 45 (g/min), and the weight of the object material which could be ground to powder was 5.0 kg since a grinding efficiency was low.

COMPARATIVE EXAMPLE 3

A grindstone was manufactured in the same manner as in Comparative Example 2 except that the concentration of the grains on a grindstone portion 9 was set to 45 (grains/cm$^2$). A test for grinding concrete was conducted under the same conditions as in Embodiment 1. As a result, an excellent performance was displayed with a grinding speed reaching 80 (g/min). However, the grains on an end section 8 were worn noticeably, and the lifetime of the grindstone terminated at a point in time at which the weight of the material ground to powder reached 0.2 kg.

INDUSTRIAL APPLICABILITY

As is clear from the embodiments and comparative examples, the grindstone according to the present invention is capable of attaining both a very high grinding speed and a high flat grindability and, furthermore, maintaining the performance for a long period of time since the grindstone is designed so that the concentration of the grains is high in a region on an outer circumferential end section of a grindstone portion, and low in the other region.

According to another example of the present invention, the concentration of the grains on a grindstone portion of a grindstone is set high in a region in the vicinity of an outer circumferential end section of the grindstone portion, and also high in a region in the vicinity of an inner circumferential surface section of the grindstone portion. Owing to this arrangement, the concentrated abrasion of the grains on an inner circumferential section (offset section) of the grindstone portion is avoided even in an operation for grinding an object material having a greatly irregular surface, so that the lifetime prolonging performance of the grindstone is remarkably improved.

What is claimed is:

1. An offset type grindstone comprising:

a circular metal substrate provided in a central section of the grindstone with a recess having a hole used to mount the grindstone on a power tool; and a grindstone portion including a layer including at least one of diamond grains and cBN grains, the grindstone portion being molded on the substrate;

wherein a concentration of the grains on the grindstone portion is higher in a region of an outer circumferential end section of the grindstone portion, and lower in another region of the grindstone portion than in the outer circumferential end section.

2. A grindstone according to claim 1, wherein the concentration of the grains on the grindstone portion is 50 to 1600 (grains/cm$^2$) in both the outer circumferential end section of the grindstone portion and a region that extends by 0 to 10 mm from the outer circumferential end section toward a center of the metal substrate, and the concentration of grains is 5 to 400 (grains /cm$^2$) and lower than the concentration in the outer circumferential end section in the another region of the grindstone portion.

3. A grindstone according to claim 1, wherein the grindstone portion includes an incline from the center of the metal substrate to the outer circumferential end section.

4. A grindstone according to claim 1, wherein the substrate includes plural stripes of non-grain-fixed regions provided within the grindstone portion.

5. A grindstone according to claim 1, wherein a through hole is provided in the circular metal substrate.

6. A grindstone according to claim 1, wherein the grindstone portion is formed by a furnace brazing method using brazing filler metal.

7. A grindstone according to claim 2, wherein the grindstone portion includes an incline from the center of the metal substrate to the outer circumferential end section.

8. A grindstone according to claim 2, wherein the substrate includes plural stripes of non-grain-fixed regions provided within the grindstone portion.

9. A grindstone according to claim 2, wherein a through hole is provided in the circular metal substrate.

10. A grindstone according to claim 2, wherein the grindstone portion is formed by a furnace brazing method using brazing filler metal.

11. An offset type grindstone comprising:

a circular metal substrate provided in a central section of the grindstone with a recess having a hole used to mount the grindstone on a power tool; and a grindstone portion including a layer including at least one of diamond grains and cBN grains, the grindstone portion being formed with the substrate in one body;

wherein a concentration of the grains on the grindstone portion is higher in a region of an outer circumferential end section of the grindstone portion and a region of an inner circumferential section of the grindstone portion, and lower in another region of the grindstone portion than in the outer circumferential end section.

12. A grindstone according to claim 11, wherein the concentration of the grains on the grindstone portion is 50 to 1600 (grains /$cm^2$) in both the outer circumferential end section of the grindstone portion and a region that extends by 0 to 10 mm from the outer circumferential end section toward a center of the metal substrate, and the concentration of grains is 30 to 1600 (grains/$cm^2$) in both the innermost circumferential section of the grindstone portion and a region that extends by 0 to 10 mm from the innermost circumferential section of the grindstone portion toward the outer circumferential end section of the grindstone portion, and the concentration of grains is 5 to 400 (grains/$cm^2$) and lower than the concentration in the outer circumferential end section and the innermost circumferential section, in another region of the grindstone portion.

13. A grindstone according to claim 11, wherein the grindstone portion includes an incline from the center of the metal substrate to the outer circumferential end section.

14. A grindstone according to claim 12, wherein the grindstone portion includes an incline from the center of the metal substrate to the outer circumferential end section.

15. A grindstone according to claim 11, wherein the substrate includes plural stripes of non-grain-fixed regions provided within the grindstone portion.

16. A grindstone according to claim 12, wherein the substrate includes plural stripes of non-grain-fixed regions provided within the grindstone portion.

17. A grindstone according to claim 11, wherein a through hole is provided in the circular metal substrate.

18. A grindstone according to claim 12, wherein a through hole is provided in the circular metal substrate.

19. A grindstone according to claim 11, wherein the grindstone portion is formed by a furnace brazing method using brazing filler metal.

20. A grindstone according to claim 12, wherein the grindstone portion is formed by a furnace brazing method using brazing filler metal.

* * * * *